United States Patent [19]

Tomita et al.

[11] Patent Number: 4,671,228

[45] Date of Patent: Jun. 9, 1987

[54] FOUR STROKE INTERNAL COMBUSTION ENGINE

[75] Inventors: Takao Tomita, Saitama; Masaaki Matsuura, Tokyo; Makoto Hirano, Saitama; Masao Handa, Tokyo; Tomoo Shiozaki, Saitama, all of Japan

[73] Assignee: Honda Giken Kogyo Kabushiki Kaisha, Tokyo, Japan

[21] Appl. No.: 823,337

[22] Filed: Jan. 28, 1986

[30] Foreign Application Priority Data

Jan. 29, 1985 [JP] Japan ..... 60-13513
Feb. 13, 1985 [JP] Japan ..... 60-25807
Feb. 13, 1985 [JP] Japan ..... 60-25808

[51] Int. Cl.[4] ..... F02F 1/47

[52] U.S. Cl. ..... 123/193 P; 123/193 CP; 123/315; 123/432; 92/177

[58] Field of Search ..... 123/193 R, 193 C, 193 P, 123/193 CP, 315, 432; 92/177

[56] References Cited

U.S. PATENT DOCUMENTS 4,198,065 4/1980 Fukui ..... 277/217
4,256,068 3/1981 Irimajiri et al. ..... 123/193 P
4,266,787 5/1981 Fukui ..... 277/160
4,306,730 12/1981 Honda et al. ..... 277/217
4,350,126 9/1982 Honda ..... 123/315
4,363,300 12/1982 Honda ..... 92/177
4,383,508 5/1983 Irimajiri et al. ..... 123/193 P
4,466,400 8/1984 Irimajiri et al. ..... 123/193 P
4,502,434 3/1985 Irimajiri et al. ..... 123/193 P

FOREIGN PATENT DOCUMENTS 142516 5/1920 United Kingdom ..... 123/193 P
1256401 12/1971 United Kingdom ..... 123/432
2134977A 8/1984 United Kingdom .

*Primary Examiner*—Craig R. Feinberg
*Attorney, Agent, or Firm*—Lyon & Lyon

[57] ABSTRACT

Engines having cylinders of noncircular cross section wherein the cylindrical curve is generated at a preselected constant outwardly normal distance from a closed curve. The closed curve is defined as including two spaced points on a major axis of symmetry of the cylinder with two continuously curved portions extending between these points and curved outwardly from the major axis. The closed curve about which the cylinder curve is generated is preferred such that there is a continuous change of curvature without discontinuity in that curvature in the cylindrical curve. The avoidance of discontinuity in the generating curve aids in mass production consideration and cutter life. A plurality of intake and exhaust port arrangements are disclosed illustrating four intake ports and four exhaust ports on opposite sides of the major axis of symmetry of the defined cylinder. In one embodiment, the outermost of the ports are smaller and are positioned closer to the major axis of symmetry. In another, the valves are oriented such that the stems thereof point to the centerline of the associated camshaft for direct actuation.

11 Claims, 16 Drawing Figures

FOUR STROKE INTERNAL COMBUSTION ENGINE

BACKGROUND OF THE INVENTION

The field of the present invention is four cycle engines having cylinders of noncircular cross section.

Engines have been developed which employ cylinders of noncircular cross section. Such engines which have an oblong cross section can increase the inlet and outlet port areas relative to the cross-sectional area of the cylinder over that which is possible with cylinders of circular cross section. Valve arrangements have been devised for such engines to increase aspiration efficiency. One such engine is illustrated in U.S. Pat. No. 4,256,068 issued to Shoichiro Irimajiri et al and entitled OBLONG PISTON AND CYLINDER FOR INTERNAL COMBUSTION ENGINE.

Such existing four cycle internal combustion engines whose cylinders are not circular in cross section have been devised in accordance with the shapes illustrated in FIGS. 1, 2 and 3. In FIG. 1, the cylinder H is shown to be two semicircular sections connected by two straight segments. The semicircular sections have the radius r and the straight sections extend between points $P_1$. FIG. 2 illustrates another embodiment of a cylinder H having circular segments $S_1$ of short radius $r_1$ and circular segments $S_2$ of long radius $r_2$. The segments are connected at points $P_2$. Engine cylinders, as illustrated in FIGS. 1 and 2, constructed of distinct differently curved segments require points of curvature discontinuity such as found at $P_1$ and $P_2$. With such discontinuities, a cutter employed in the forming of the surfaces of such cylinders is unable to smoothly traverse these points. As a result, high accuracy cannot be obtained, excessive time is required for the processing of the cylinder and the cutter experiences early wear. Thus, mass production becomes difficult although engines conforming to the cylinder designs of FIGS. 1 and 2 can improve gas flow efficiency and can be made using limited production techniques.

A further cylinder H which has been previously contemplated for cylinders of noncircular cross section is illustrated in FIG. 3. FIG. 3 has a true elliptical form. This form is more amenable to mass production techniques. As there is no curvature discontinuity, high accuracy, reduced processing time and longer cutter life may be realized. However, such a true ellipse creates areas D at either end of the cylinder which are narrowed considerably compared to the midsection of the cylinder. Dead spaces occur in this area as there is insufficient room for valve placement. Furthermore, the end portions of the cylinder are so curved that it becomes difficult to prepare and assemble a ring on a conforming piston in these areas.

Piston rings for such cylinders having noncircular cross sections have been devised. One such type of ring is the "expansion type" which is pressed outwardly against the inner wall of the cylinder by a device fitted between the piston and the piston ring. One such device is illustrated in U.S. Pat. No. 4,362,135 to Shoichiro Irimajiri, entitled PISTON RING OF INTERNAL COMBUSTION ENGINE. Another type of piston ring which has been devised for such cylinders is the self tension type which is pressed against the inner wall of the cylinder by means of its own tensile strength with the relaxed position of the ring being larger than the cylinder within which it is compressed. One such ring for a noncircular cylinder is disclosed in U.S. Pat. No. 4,198,065 to Takeo Fujui entitled PISTON RING FOR INTERNAL COMBUSTION ENGINE. The self tensioning type of piston ring tends to be more widely used as it has more advantages in terms of better sealing quality and cost.

As mentioned above, certain problems may accompany the fabrication and installation of such piston rings on pistons designed to conform to noncircular cylinders. With each of the cross-sectional shapes of cylinders illustrated in FIGS. 1 and 2, the abrupt or discontinuous change in curvature at either points $P_1$ or $P_2$ also required of the piston ring can result in stress concentrations in use. Fabrication of such curves may also be more difficult and, where straight sections are employed, they preferably include inwardly curved configurations in the relaxed state to overcome bending loads when positioned in the cylinder. Maintaining accuracy in the fabrication of such complex curves becomes difficult.

Consequently, the fabrication and assembly of components for engines having noncircular cylinders as illustrated in FIGS. 1 and 2 can be difficult. The configuration of FIG. 3 overcomes certain of the fabrication problems encountered with the configurations of FIGS. 1 and 2. However, ring assembly with the piston may be difficult and dead spaces can occur at the narrowed ends of the elliptical cylinder.

SUMMARY OF THE INVENTION

The present invention is directed to engines having cylinders of noncircular cross section. The shape of a cylinder and the conforming piston and piston ring therefor according to the present invention is defined by a continuously curving symmetrical oval cross section. In a first aspect of the present invention, the cylinder is generated at a preselected constant outwardly normal distance from a closed curve. The closed curve has a continuous curvature and includes two spaced points on an axis of the cylinder cross section and two curved portions extending between the points and being curved outwardly from the axis. Thus, the closed curve may be of oval shape without curvature discontinuity.

The foregoing arrangement eliminates discontinuities in the curvature defining the cylinder. Production may be enhanced by such a curvature, stresses on the components can be reduced and the narrowed ends of the cylinder are comparatively broad enough to receive valves to eliminate dead spaces.

In another aspect of the present invention, valves are arranged symmetrically about the minor axis of an oval cylinder. The arrangement of the valves may include smaller valves and valve ports at the narrowed portions of the cylinder and larger valves and valve ports adjacent the minor axis thereof. The centers of such valves may also vary depending on the distance from the minor axis of the cylinder and such valves may be angled such that all intake valves point to the centerline of a first cam shaft and all exhaust valves point to the centerline of a second cam shaft.

Accordingly, it is an object of the present invention to provide an improved configuration for a noncircular cylinder. A further object of the present invention is to provide advantageous porting arrangements associated with such a noncircular cylinder. Other and further objects and advantages will appear hereinafter.

DETAILED DESCRIPTION OF THE PREFERRED EMBODIMENT

Figure 1:
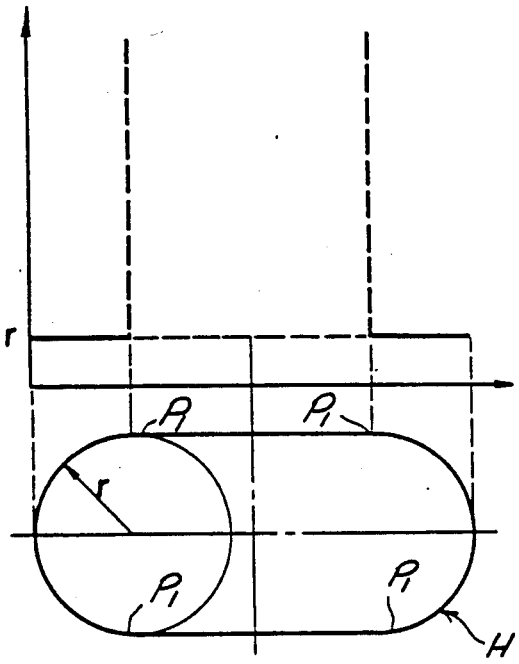
FIG. 1. PRIOR ART
FIG. 1 is a prior art schematic of a noncircular cylinder configuration.
Figure 2:
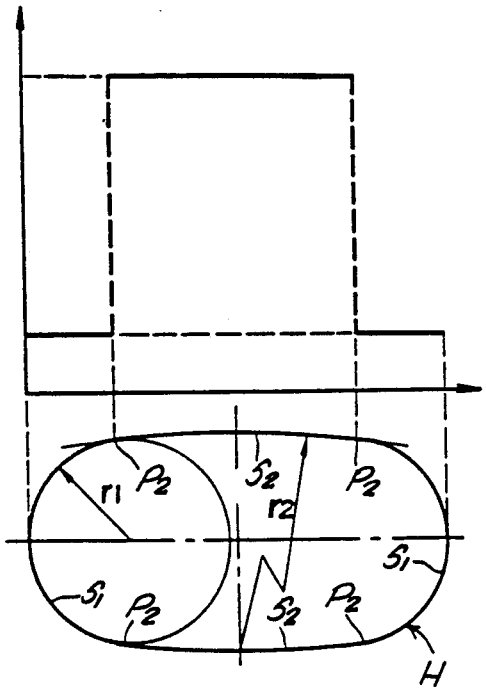
FIG. 2. PRIOR ART
FIG. 2 is a second prior art schematic of a noncircular cylinder configuration.
Figure 3:
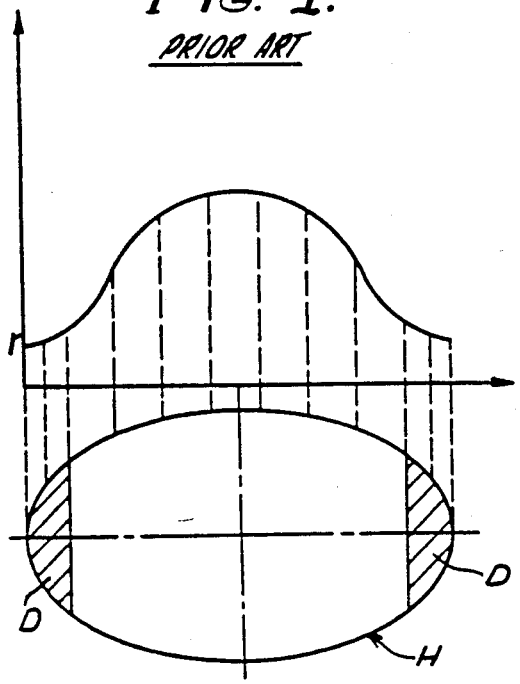
FIG. 3. PRIOR ART
FIG. 3 is a third prior art schematic of a noncircular cylinder configuration.
Figure 4:
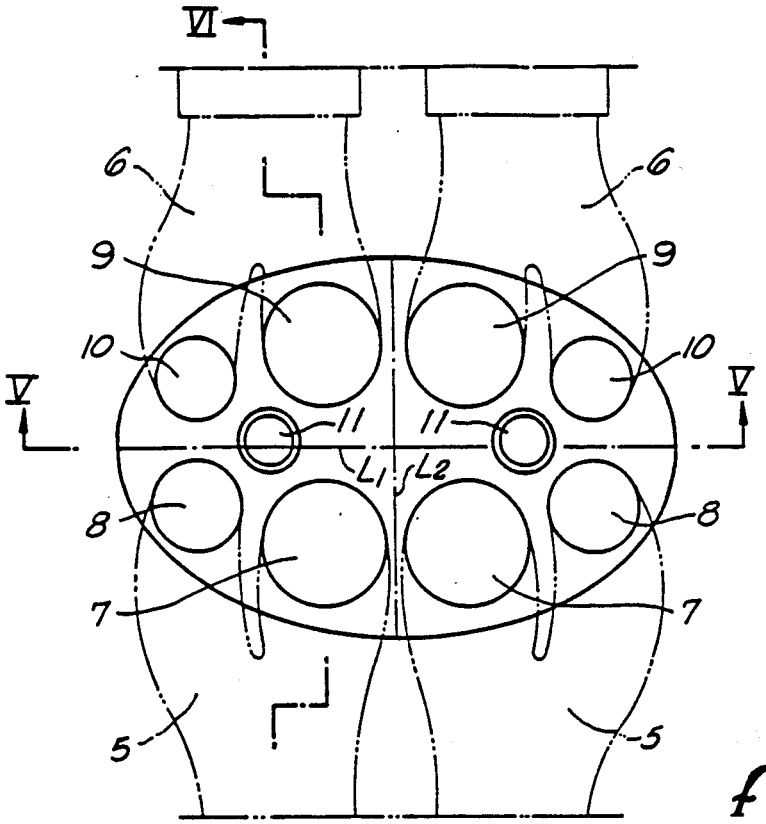
FIG. 4 is a schematic plan view of a first embodiment of the present invention illustrating a cylinder of noncircular cross section.
Figure 5:
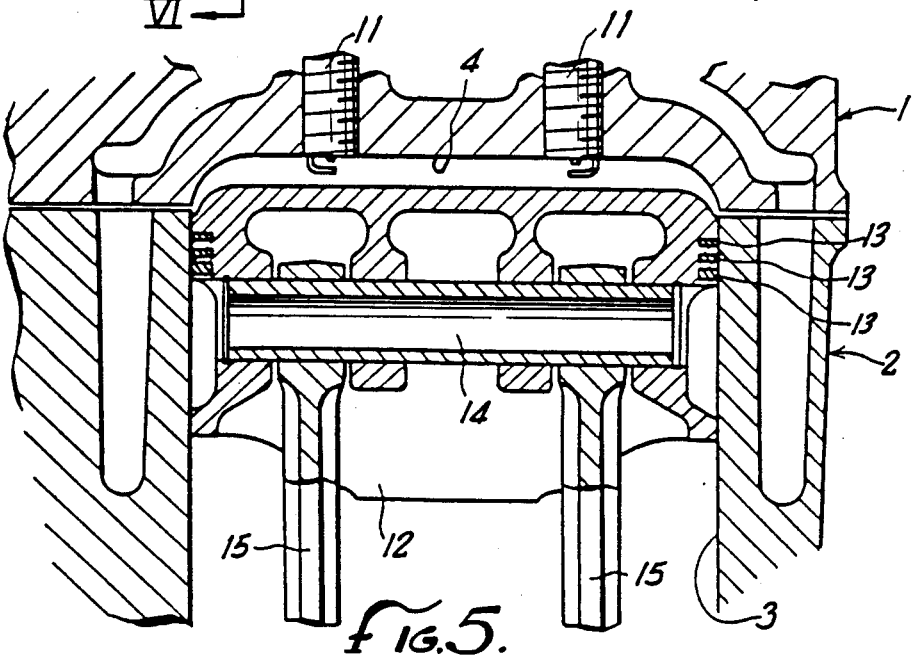
FIG. 5 is a cross-sectional elevation taken along line V—V of FIG. 4.
Figure 6:
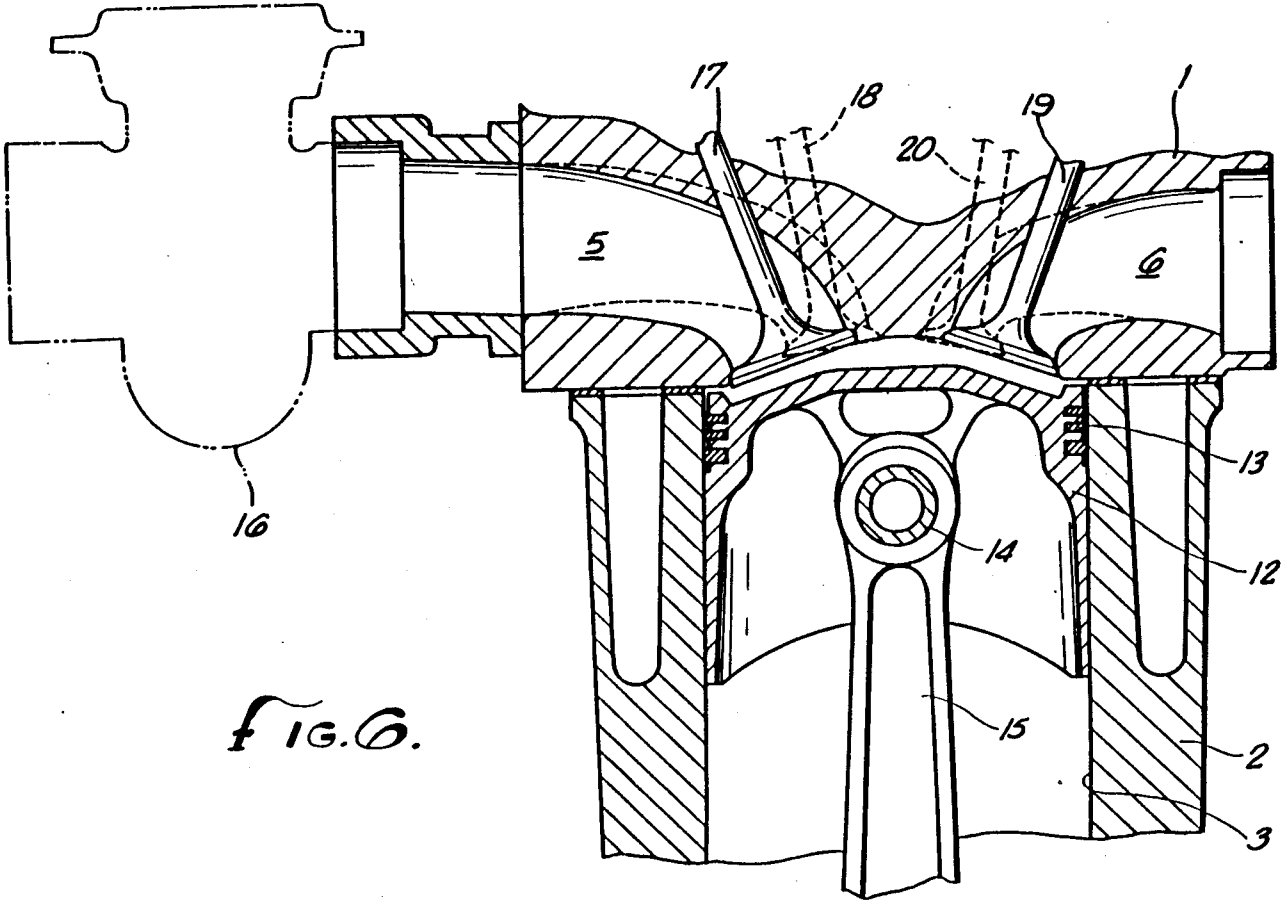
FIG. 6 is a cross-sectional elevation taken along line VI—VI of FIG. 4.

Turning in detail to the drawings, FIGS. 4, 5 and 6 illustrate a first embodiment of the present invention. The engine is shown to include a cylinder head 1 and cylinder body 2. The cylinder body 2 includes a cylinder 3 therein. The cylinder 3 is illustrated in FIG. 4 to have a continuously curving symmetrical oval cross section having a major axis of symmetry along line $L_1$ and a minor axis of symmetry along line $L_2$. The cylinder head 1 closes one end of the cylinder and is affixed to the cylinder body 2. The cylinder head 1 has a ceiling 4 defining one portion of the combustion chamber. Two intake passages 5 direct incoming mixture to the combustion chamber while exhaust passages 6 direct exhaust away from the combustion chamber on the other side thereof. Each of the intake passages 5 and each of the exhaust passages 6 are shown to be branched so as to extend to separate ports. Large intake ports 7 are arranged near the minor axis of symmetry $L_2$ on one side of the major axis of symmetry $L_1$. Smaller intake ports 8 are located more distant from the minor axis of symmetry $L_2$ and closer to the major axis of symmetry $L_1$ than the larger intake ports 7. Similarly, exhaust ports 9 and 10 are provided. The exhaust ports 9 are larger than the exhaust ports 10 and are found to be closer to the minor axis of symmetry $L_2$ and further from the major axis of symmetry $L_1$. Two spark plug ports 11 are illustrated to be spaced from one another along the major axis of symmetry $L_1$.

The piston 12 is shown to conform to the continuously curving symmetrical cross section of the cylinder 3. Piston and oil rings 13 provide a seal between the piston 12 and the surrounding cylinder wall 3. The piston is constrained to reciprocate within the cylinder 3, it being attached by means of a wrist pin 14 to dual connecting rods 15.

The flow through intake passages 5 from carburetors 16 are controlled at the intake ports 7 and 8 by means of intake valves 17 and 18. In this first embodiment, the intake valves 17 and 18 are shown to be mutually askew in order to better conform to the curved ceiling structure 4 of the cylinder head 1. Similarly, exhaust valves 19 and 20 control the exhaust ports 9 and 10, respectively to exhaust gases through the exhaust passages 6 to an exhaust system, not shown.

The arrangement of the ports 7 through 10 provide an advantageous use of the cylinder configuration. The smaller ports 8 and 10 may be placed closer together and, therefore, nearer the narrowed ends of the cylinder cross section. Their placement closer to the major axis of symmetry $L_1$ for the cylinder cross section also enables their placement at the more extreme positions. Under certain conditions, it may be advantageous to only employ the center ports 7 and 9. Mechanisms have been devised for disabling valves under certain operating conditions. The location of the spark plugs 11 reduce the length of the flame path upon ignition and avoid interfering with the valves and valve port area.

The foregoing arrangement illustrates a noncircular cylinder having four intake valves on one side the major axis of symmetry and four exhaust valves on the other side of the major axis of symmetry of the cylinder. The valves are shown to be symmetrically arranged relative to the minor axis of symmetry of the cylinder. However, a different number and arrangement of valves may be employed where desired. For example, an additional intake valve may be located on the minor axis of symmetry to further enhance intake operation. Other configurations might include a third spark plug located centrally in the cross section.

Figure 7:
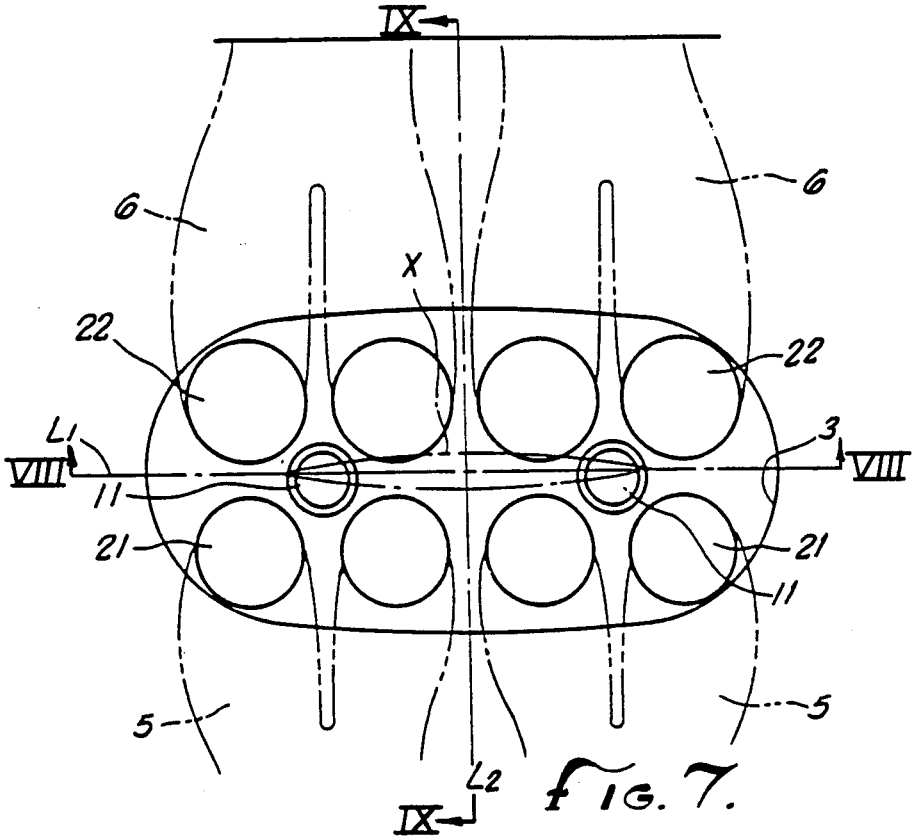
FIG. 7 is a schematic plan view of a second embodiment of the present invention.
Figure 8:
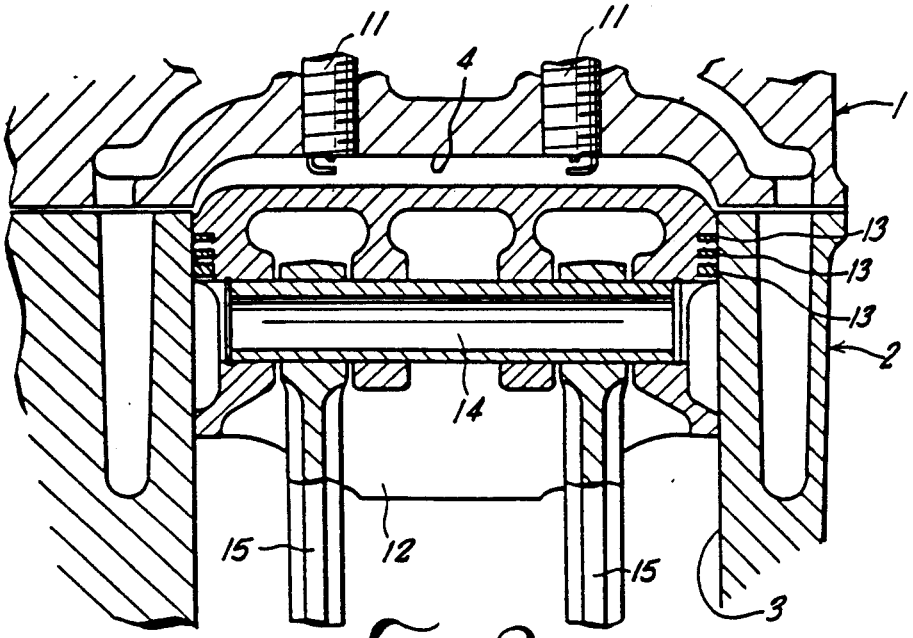
FIG. 8 is a cross-sectional elevation taken along line VIII—VIII of FIG. 7.
Figure 9:
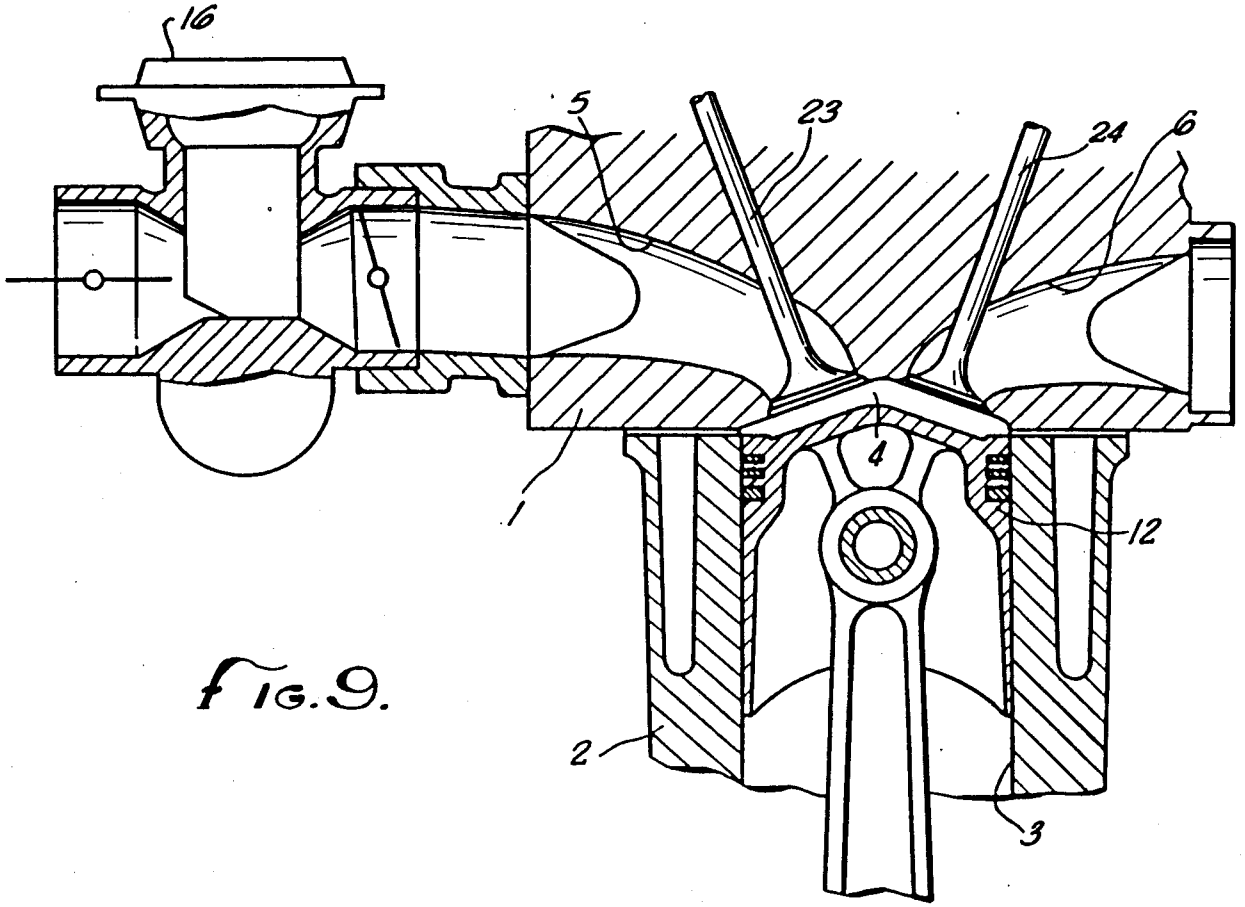
FIG. 9 is a cross-sectional elevation taken along IX—IX of FIG. 7.

A second embodiment of the present invention is illustrated in FIGS. 7 through 9. Similar numbers have been given to the elements of this second embodiment where they are identical or equivalent. A principal change between embodiments is the size and orientation of the intake ports 21 and exhaust ports 22. Both sets of ports are arranged in this embodiment along straight lines parallel to the major axis of symmetry of the cylinder $L_1$. The ports 21 are all the same size as are the ports 22. In accordance with the size and orientation of the ports 21 and 22, the intake valves 23 are aligned in parallel with one another as are the exhaust valves 24.

Figure 10:
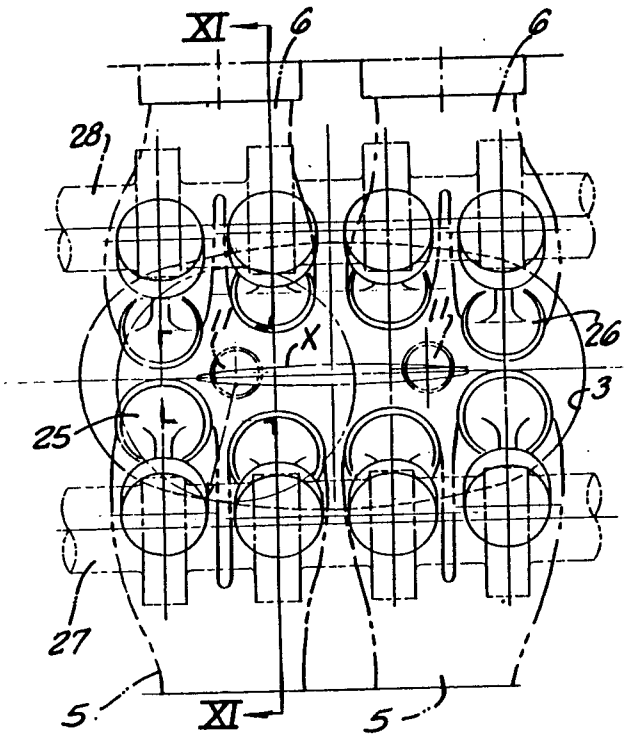
FIG. 10 is a schematic plan view of another embodiment of the present invention.
Figure 11:
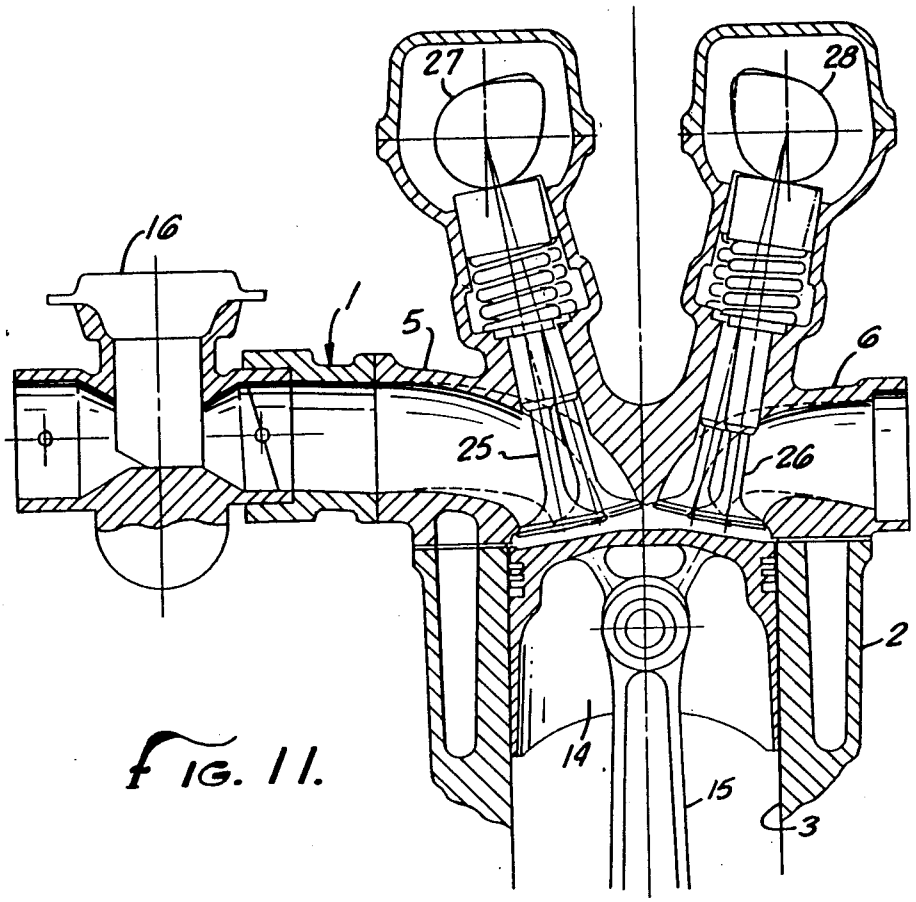
FIG. 11 is a cross-sectional elevation taken along line XI—XI of FIG. 10.

A third embodiment is illustrated in FIGS. 10 and 11. Again, similar numbers have been assigned identical or equivalent elements. In FIG. 11, the orientation of the valves is illustrated with each intake valve 25 and each exhaust valve 26 pointing toward a respective intake camshaft 27 and exhaust camshaft 28. In this way, the valves 25 and 26 may be driven directly by these cams. As can be seen in FIG. 10, the valves 25 and 26 at the outer ends of the cylinder are placed closer to the major axis of symmetry of the cylinder.

Figure 12:
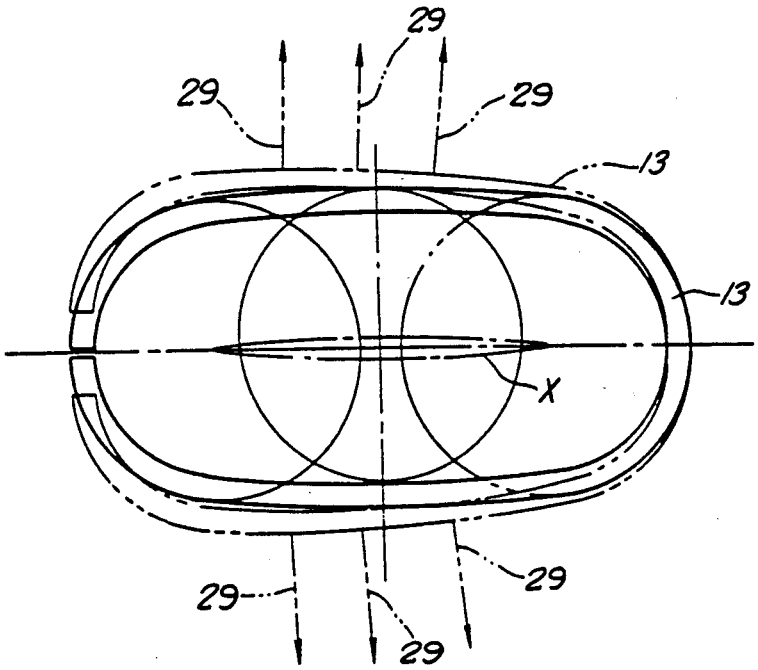
FIG. 12 is a plan view of a piston ring illustrated in full in a compressed state and illustrated in phantom in a related state as may be employed in the embodiments of FIGS. 4, 7 and 10.

A piston ring is illustrated in FIG. 12 which may be employed with the cylinders and pistons of FIGS. 4, 7 and 10. The piston ring 13 is shown as having a break at one end. In the free configuration of the piston ring, illustrated in phantom, it can be seen that the ring continuously curves without reversing curvature at any point. Consequently, the outwardly normal lines 29 do not intersect one another. The ring 13 is shown in its compressed state in full line.

Figure 13:
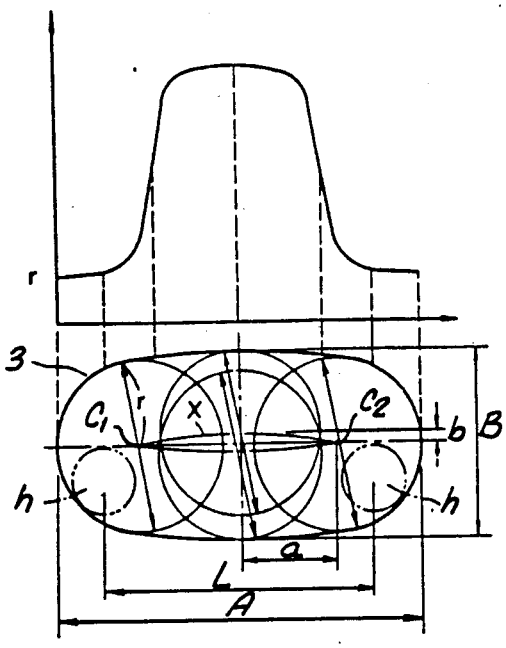
FIG. 13 illustrates the construction of a cylinder according to the present invention and the corresponding graph of radius of curvature versus axial position along the major axis of the cylinder.

The construction of the cylinder having a continuously curving symmetrical oval cross section is best understood with reference to FIG. 13. The curve defining the cylinder wall is generated at a preselected constant outwardly normal distance from a closed curve. The closed curve is identified as X in FIG. 13 and the curve of the cylinder is generated by the normal thereto. This normal may be best understood as the locus of outermost points defined by a circle of a given radius r having the center of that circle move about the closed curve X. The curve X extends symmetrically about the major axis of symmetry of the cylinder between two spaced points $C_1$ and $C_2$. The curve X is curved outwardly from the major axis between these points on either side of the major axis. As can be seen from the curve associated with FIG. 13 illustrating the relationship between the location along the cylinder 3 to the radius of curvature, the curvature is continuous about the entire cylinder. The selection of the curve X is designed to accomplish this result.

If the closed curve X is selected to be a formal ellipse, such a continuously varying curvature without discontinuities therein will result. The nature of the closed curve X employed for generating the curve of the cylinder determines the path which a cutter is required to follow having a radius r to cut the appropriate cylinder wall. If the closed curve X is a formal ellipse, for example, the cutter will not be required to undertake any discontinuous movements. This facilitates processing, reduces machining time, increases the life of the cutter and increases accuracy. The resulting curvature of the cylinder, the associated piston and the associated piston rings also avoid high stress points and thermal stress concentrations at discontinuities. The employment of this technique in the generation of the cylinder creates the broadened end portions not realized with a cylinder of an elliptical shape. Consequently, the intake and exhaust ports may be positioned deep in the narrowed portions of the cylinder to avoid dead spaces.

Figure 14:
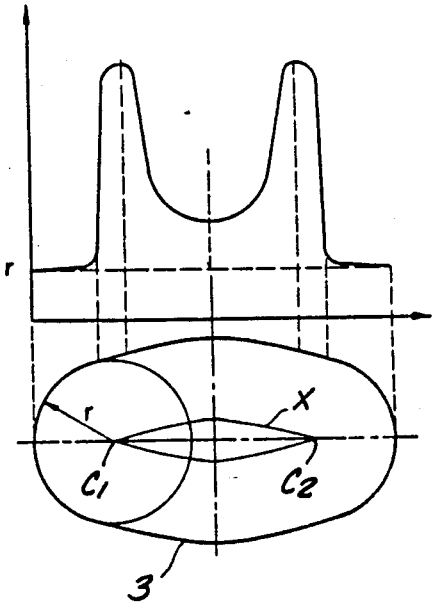
FIG. 14 illustrates another embodiment of a cylinder of noncircular cross section and its attendant profile of radius of curvature versus axial position on the major axis of the cylinder.

A variety of curves may be selected to define the cylindrical wall. FIG. 14 illustrates yet another cylinder arrangement generated by the same means. In spite of the steep slopes evident in these curves, they remain continuous. These slopes reflect the very tight curves near the points $C_1$ and $C_2$ on curve X where they transition to the much straighter sections. Naturally, the more steep the curve, the more difficulty the cutter has in following curve X to cut the cylinder. A formal ellipse which also may be employed for curve X typically is reflected in more gradual slopes on such curves resulting in less abrupt cutter action in forming the associated cylinder.

Figure 15:
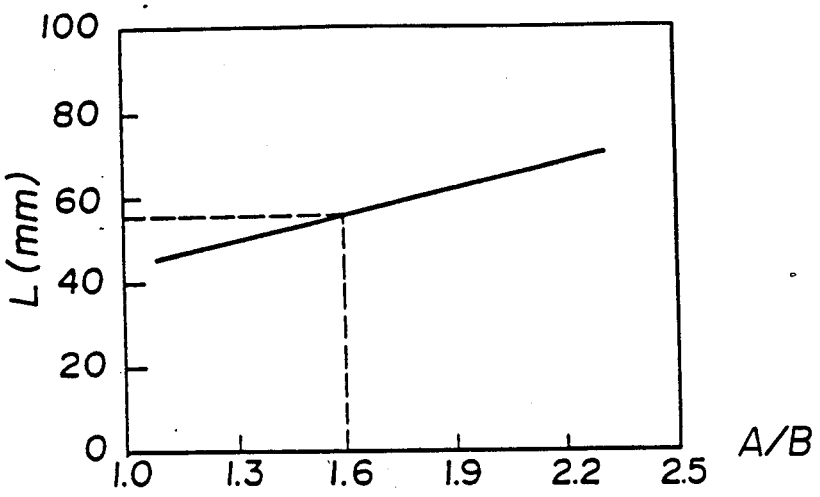
FIG. 15 is a curve illustrating the relationships of the axes as labeled.
Figure 16:
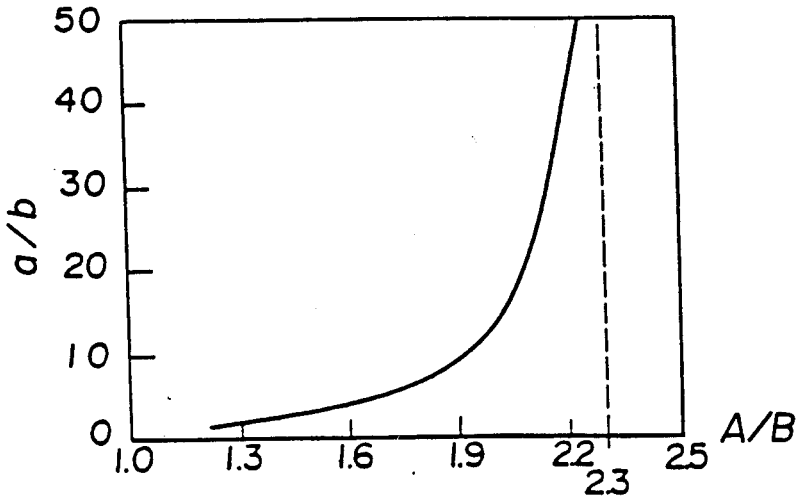
FIG. 16 is a curve illustrating the relationship of these axes as labeled.

Looking then to FIGS. 15 and 16, the special characteristics for cylinders according to the preferred embodiments are illustrated with the assumptions that the diameters of the intake and exhaust outlets h as represented in FIG. 13 are 18 millimeters and the radius r of the generating circle is 20 millimeters and the cross sectional area of the cylinder is fixed. FIG. 15 represents the relationship between the ratio of the long diameter A to the short diameter B of the cylinder curve and the distance between the centers of the most distant of either the intake or exhaust ports h with the intake and exhaust ports arranged as in FIG. 7 (the distance L in FIG. 13). Assuming four intake ports and four exhaust ports with a diameter of 18 millimeters, the distance L, as seen in FIG. 13, between the centers of the ports must be at least 54 millimeters. In this case, A/B becomes more than 1.6 in accordance with FIG. 15. Referring to FIG. 16, the relationship of the foregoing ratio A/B and the ratio of the long diameter a of the closed curve X to the short diameter b of the closed curve X is illustrated. As can be seen from FIG. 16, for any value of A/B, A/B never exceeds 2.3. Consequently, from FIGS. 15 and 16 it can be seen that under the foregoing assumptions with ports in the foregoing relationship, the ratio A/B is greater or equal to 1.6 and is less than or equal to 2.3. As a result, preferred relationships of components preferably satisfy the foregoing limitations.

Thus, cylinders having noncircular cross sections are disclosed which may be fabricated under mass production conditions, avoid dead spaces in the combustion chamber adjacent the ends of oblong cylinders, provide improved valve configurations and improved piston ring configurations. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An internal combustion engine comprising a cylinder having a continuously curving symmetrical oval cross section with a major axis of symmetry and a minor axis of symmetry;

an oval piston in said cylinder; and a cylinder head covering one end of said cylinder and including a plurality of valved ports in said head which are symmetrically arranged relative to said minor axis with some of said plurality of ports having respective centers being at a different distance from said minor axis than centers of others of said plurality of ports, said ports closest to said minor axis having a larger port area than said ports furthest from said minor axis wherein said centers of said ports furthest from said minor axis are closer to said major axis than said centers of said ports closest to said minor axis.

2. The internal combustion engine of claim 1 further comprising a piston ring about said piston and extending to said cylinder.

3. The internal combustion engine of claim 1 wherein said plurality of ports includes intake ports on one side of said major axis and exhaust ports on the other side of said major axis.

4. The internal combustion engine of claim 3 wherein there are four said intake ports.

5. The internal combustion engine of claim 3 wherein there are four said exhaust ports.

6. The internal combustion engine of claim 3 wherein there are an equal number-of intake and exhaust ports.

7. An internal combustion engine comprising a cylinder having a continuously curving symmetrical oval cross section with a major axis of symmetry and a minor axis of symmetry;

an oval piston in said cylinder;

a piston ring about said piston and extending to said cylinder; and a cylinder head covering one end of said cylinder and including a plurality of valved intake ports and a plurality of valved exhaust ports in said head, said intake ports being on one side of said major axis, symmetrically arranged relative to said minor axis and having centers arranged at different distances from said minor axis, said intake ports with said centers closest to said minor axis having a larger port area than said intake ports with said centers furthest from said minor axis, said exhaust ports being on the other side of said major axis, symmetrically arranged relative to said minor axis and having centers arranged at different distances from said minor axis, said intake ports with said centers closest to said minor axis having a larger port area than said intake ports with said centers furthest from said minor axis, wherein said centers of said ports furthest from said minor axis are closer to said major axis than said centers of said ports closest to said minor axis.

8. The internal combustion engine of claim 7 further comprising two spark plugs symmetrically disposed to either side of said minor axis on said major axis.

9. The internal combustion engine of claim 7 wherein there are four intake ports and four exhaust ports.

10. The internal combustion engine of claim 3 further comprising intake valves in said intake ports;

exhaust valves in said exhaust ports;

a first camshaft coupled with said intake valves; and a second camshaft coupled with said exhaust valves.

11. The internal combustion engine of claim 10 wherein said intake valves are on one side of said major axis and point at the centerline of said first camshaft and said exhaust valves are on the other side of said major axis and point at the centerline of said second camshaft.

* * * * *